United States Patent [19]

Altmayer

[11] Patent Number: 4,927,089

[45] Date of Patent: May 22, 1990

[54] ROCK CRUSHERS

[75] Inventor: Joseph Altmayer, Kitchener, Canada

[73] Assignee: E&E Seegmiller Limited, Kitchener, Canada

[21] Appl. No.: 263,865

[22] Filed: Oct. 28, 1988

[51] Int. Cl.[5] ..... B02C 1/04

[52] U.S. Cl. ..... 241/264

[58] Field of Search ..... 241/37, 36, 264, 269, 241/32, 231, 289, 290

[56] References Cited

U.S. PATENT DOCUMENTS

| | | | |
|---|---|---|---|
| 3,099,406 | 7/1963 | Kautz . | |
| 3,315,902 | 4/1967 | Pollitz . | |
| 3,938,732 | 2/1976 | Schrimper et al. . | |
| 3,976,255 | 8/1976 | Edwards | 241/264 |
| 3,984,151 | 10/1976 | Altmayer . | |
| 4,749,132 | 6/1988 | Hagiwara et al. | 241/37 X |

FOREIGN PATENT DOCUMENTS

| | | | |
|---|---|---|---|
| 1239183 | 4/1967 | Fed. Rep. of Germany . | |
| 1276422 | 8/1968 | Fed. Rep. of Germany . | |
| 1197731 | 12/1985 | U.S.S.R. | 241/264 |

*Primary Examiner*—Mark Rosenbaum

*Attorney, Agent, or Firm*—Gowling, Strathy & Henderson

[57] ABSTRACT

Hydraulic control system for controlling the movement of the movable jaw of a rock crusher between a first set position and a retracted position. The control system includes a double acting hydraulic ram having first and second ends mounted on the frame of the rock crusher and movable jaw respectively. A source of high pressure hydraulic fluid provided. A first fluid supply conduit communicates between the source of high pressure fluid and a first fluid chamber of the ram. A second fluid supply conduit communicates between the source of high pressure fluid and the second fluid chamber of the ram. A flow control device is provided in the first and second fluid supply conduits for simultaneously locking hydrulic fluid in the first and second fluid supply conduits to hold the extensible ram in a substantially rigid fixed length condition when in the set position during normal operation of the crusher. A pressure relief device communicates with the first fluid chamber to relieve the pressure in said chamber when the pressure in the first fluid chamber exceeds a predetermined control pressure to free the movable jaw for movement toward said retracted position.

2 Claims, 3 Drawing Sheets

ROCK CRUSHERS

Figure 2:
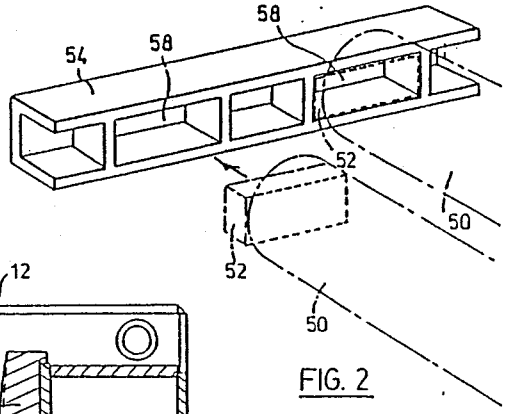

This invention relates to rock crushers.

In particular, this invention relates to an improved hydraulic control system for controlling the movement of the movable jaws of a crusher between a first set position and a retracted position which facilitates the clearing of the bite.

BACKGROUND OF THE INVENTION

In conventional jaw crushers such as that manufactured by Protec Inc. and identified by the trade mark PIONEER 2148, the moving jaw is supported at its lower end by a plate which is commonly known as a toggle plate. Numerous attempts have been made to replace this toggle plate with a yieldable ram. One such device is described in U.S. Pat. No. 3,099,406, Kautz, dated July 30, 1963. In this device, overload protection is provided by employing a pneumatic damper in the control system. The problem with a pneumatic damper is that it is difficult to maintain a satisfactory seal in the pneumatic system over an extended period of time and further the pneumatic system will always tend to yield to a certain degree under the high impact loads required in order to effectively crush rock. As a consequence, it is necessary to set the pneumatic control pressure of a very high pressure. In addition, because the system combines both a pneumatic pressure system and a hydraulic pressure system, it is necessary to provide two separate power sources, one for supplying hydraulic fluid and the other for supplying pneumatic pressure. This complexity of equipment adds substantially to the cost of and the maintenance of rock crushing equipment.

It is an object of the present invention to provide a control system for controlling the movement of a movable jaw of a rock crusher which is fully hydraulic and which makes provision for accommodating overload conditions without damaging the jaws.

The control system of the present invention also permits the selective adjustment of the set position of the movable jaw.

SUMMARY OF INVENTION

According to one aspect of the present invention, there is provided in a jaw crusher for crushing rock of the type having a frame, a fixed jaw mounted on the frame and a movable jaw mounted on the frame for movement toward and away from the fixed jaw between a first set position which determines the maximum size of the gap formed between the jaws for a predetermined jaw setting and a first advanced position in which the movable jaw is located more closely adjacent the fixed jaw, and wherein the movable jaw is movable from the first set position to a retracted position in which it is more remote from the fixed jaw than it is when it is in the first set position so as to facilitate the removal of obstructing material from the bite which is formed between the jaws, the improvement of hydraulic control means for controlling the movement of the movable jaw between said first set position and said retracted position comprising, a double acting hydraulic ram having first and second ends mounted on the frame and movable jaw respectively, and being extensible and contractable between said ends, said ram comprising a cylinder, a piston slidably mounted in the cylinder and dividing the cylinder into first and second fluid chambers, a rod extending from the piston and projecting from one end of the cylinder, one of said ends of said ram being located on said cylinder and the other being located on said rod, first and second fluid ports communicating with said first and second chambers respectively, movement of said piston resulting from expansion of said first fluid chamber serving to move the movable jaw to said first set position and movement of said piston resulting from expansion of said second fluid chamber serving to move the movable jaw to said retracted position, a source of high pressure hydraulic fluid, first fluid supply conduit means communicating between said source and said first fluid chamber, second fluid supply conduit means communicating between said source and said second fluid chamber, flow control means in said first and second fluid supply means for simultaneously locking hydraulic fluid in said first and second fluid supply conduits to hold the extensible ram in a substantially rigid fixed length condition when in said set position during normal operation of the crusher, pressure relief means communicating with said first fluid chamber to relieve the pressure in said chamber when the pressure in the first fluid chamber exceeds a predetermined control pressure to free the movable jaw for movement toward said retracted position.

Figure 1:
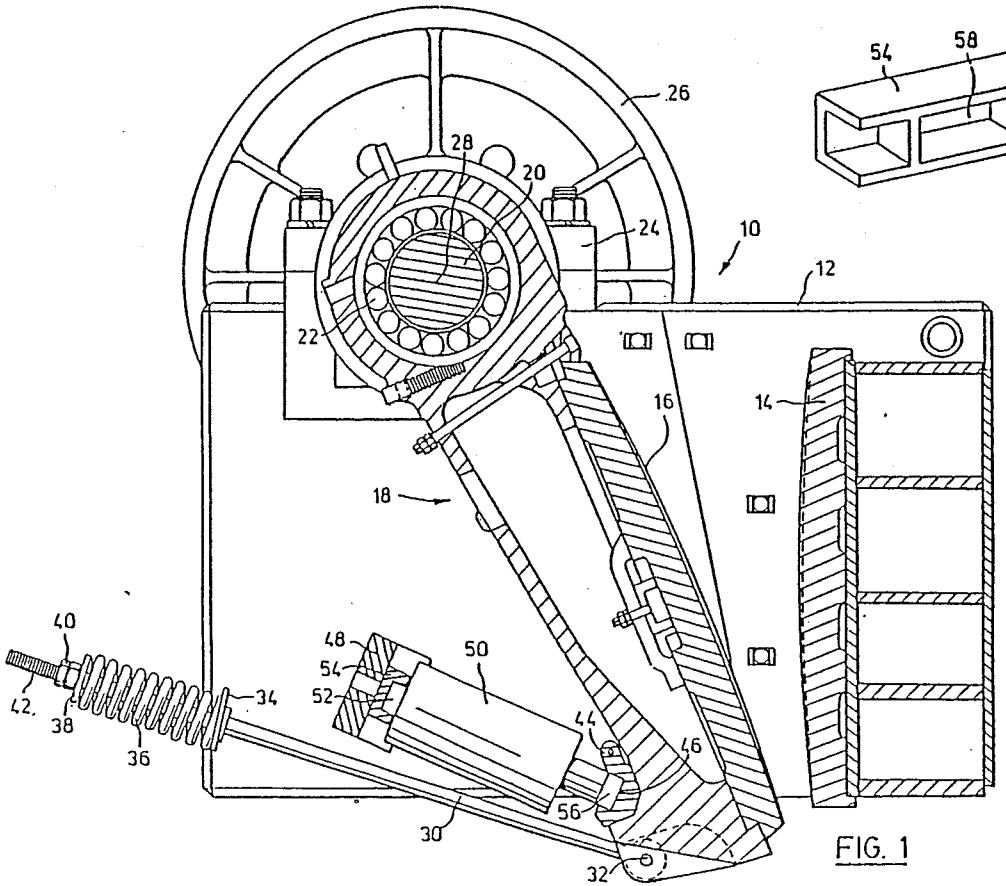
Figure 3:
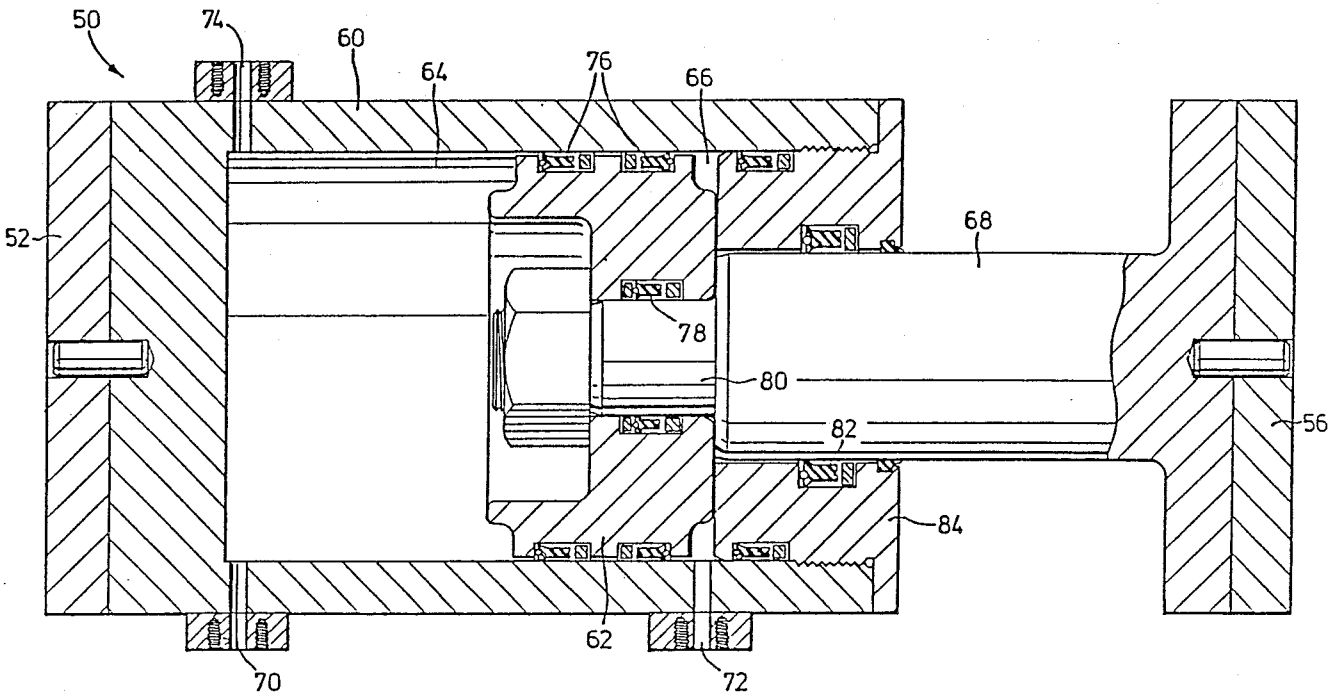
Figure 4:
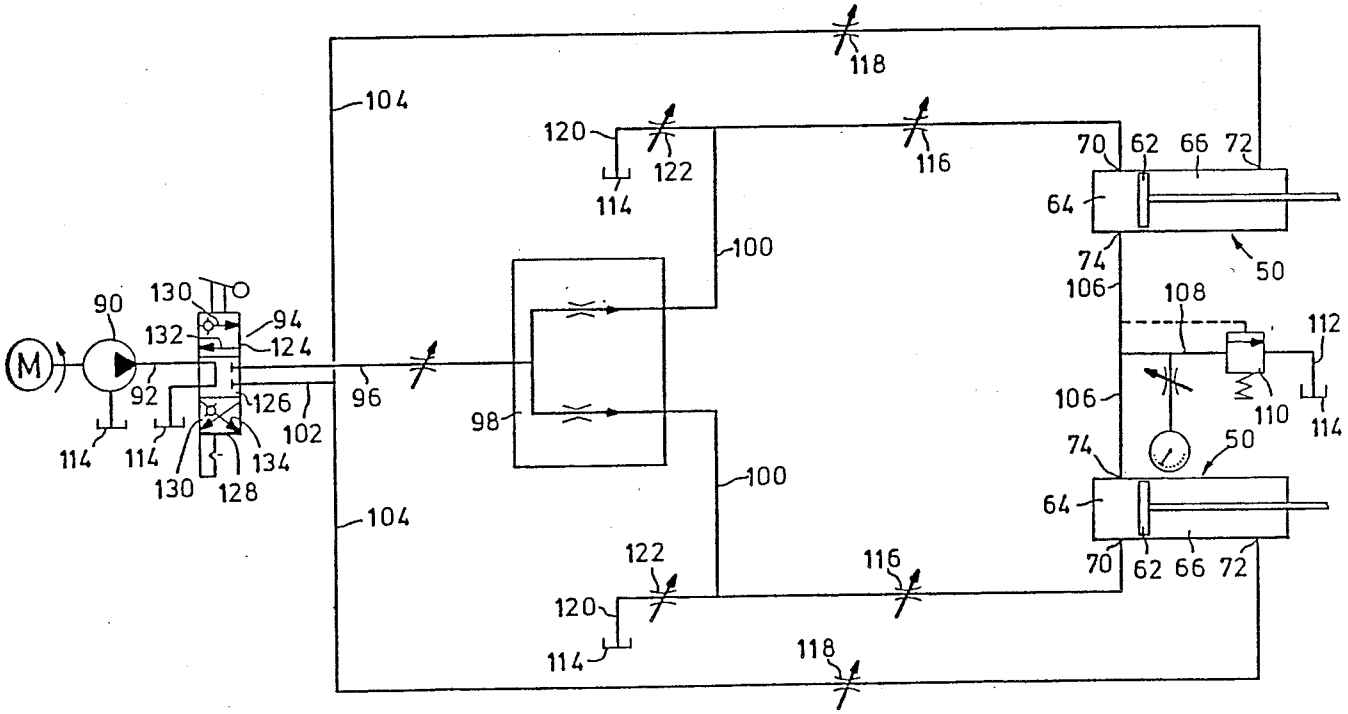

The invention will be more clearly understood after reference to the following detailed specification read in conjunction with the drawings wherein;

FIG. 1 is a sectional side view through a jaw crusher constructed in accordance with an embodiment of the present invention, FIG. 2 is a pictorial view of a portion of a support which supports the extensible rams in the frame of the crusher, FIG. 3 is a cross-sectional side view taken through an extensible ram constructed in accordance with an embodiment of the present invention showing the ram in a first position, FIG. 4 is a diagram which shows the hydraulic circuit of the hydraulic control means.

With reference to FIG. 1 of the drawings, the reference numeral 10 refers generally to a jaw crusher for use in crushing rocks constructed in accordance with an embodiment of the present invention.

The jaw crusher has a frame generally identified by the reference numeral 12 which supports a stationary jaw 14. A moving jaw 16 is supported by a mounting mechanism generally identified by the reference numeral 18 which is carried by the frame 12 and is operable to support the moving or first jaw 16 in a position disposed opposite the stationary or section jaw 14.

The mounting mechanism 18 includes a bearing 22 within which a shaft 20 is rotatable. The shaft 20 is supported by a bearing block 24 and is keyed to a drive pulley 26. The axis 28 of the portion of the shaft 20 on which the bearing 22 is mounted is eccentrically located with respect to the remainder of the shaft 20 so that rotation of the shaft 20 causes the upper end of the moving jaw 16 to describe a circle. A tie rod 30 has one end pivotally mounted by means of a pivot pin 32 at the lower end of the moving jaw 16. The tie rod 30 extends through a support plate 34 which is fixed with respect to the frame 12. A compression spring 36 is mounted between the fixed plate 34 and a collar 38 mounted on the shaft 32 by means of lock nuts 40 which are mounted on the threaded end 42 of the shaft 32. The compression spring 36 is effective to normally urge the tie rod to a position locating the lower end of the face plate spaced a substantial distance from the fixed jaw.

The moving jaw 16 has a toggle plate 44 located adjacent the lower end thereof which is formed with a recess 46. The frame includes a transverse beam 48 disposed opposite the toggle seat 46.

The mechanism which has been described with reference to FIG. 1 of the drawings is substantially identical to the structure of a PIONEER 2148 jaw crusher manufactured by Protec Inc.

The extensible rams 50 each have a first end 52 mounted in a support 54 which is fixed with respect to the transverse beam 48 which forms a part of the frame 12. The rams 50 each have a second end mounted in the channel 46 of the toggle plate 44.

As shown in FIG. 2 of the drawings, a pair of extensible rams 50 are provided and the support bracket 54 is formed with a pair of recesses 58 to receive the first end 52 of each ram. The rams 50 extend parallel to one another. It will be understood that additional rams may be added to jaw crushers of greater width.

As shown in FIG. 3 of the drawings, each double-acting hydraulic ram 50 comprises a cylinder 60 which has a piston 62 slidably mounted in the cylinder and dividing the cylinder into first and second fluid chambers 64 and 66. A rod 68 is connected to the piston 62 and projects from one end of the cylinder. A first fluid port 70 opens through the wall of the cylinder and communicates with the first fluid chamber 64. A second fluid port 72 opens through the wall of the cylinder and communicates with the second fluid chamber 66. A third fluid port 74 opens through the wall of the cylinder and communicates with the first fluid chamber 64.

Seals 76 are mounted on the piston 62 and serve to isolate the chambers 64 and 66 from one another. Similar seals 78 are located between the neck portion 80 of the rod 68 and the piston 62 to again isolate the first fluid chamber 64 from the second fluid chamber. Seals 82 are provided between the end cap 84 and the main body portion of the rod 68 to seal the second fluid chamber 66.

As shown in FIG. 4 of the drawings, a pump 90 is provided for the purposes of providing a high pressure source of hydraulic fluid. The pump 90 has an output conduit 92 which communicates with a three-position direction control valve 94.

The first fluid supply conduit system which supplies hydraulic fluid to and vents hydraulic fluid from the first chamber 64 comprises a first fluid supply conduit 96 which communicates with a flow divider 98 from which conduits 100 extend to communicate with the input ports 70 of the first fluid chamber 64. The second fluid supply conduit means which communicates between the control valve 94 and the second fluid compartments 66 consists of a first output conduit 102 which has branch lines 104 which communicate with the second ports 72.

The pressure relief means which serves to relieve the pressure in the chambers 64 comprises a pair of conduits 106 which communicate with the chambers 64 through the ports 74. A conduit 108 communicates with the conduits 106. A safety relief valve 110 is positioned in line with the conduit 108 and is preset to the safety relief pressure at which the rams will collapse the first fluid compartment 64. The safety relief valve 110 serves to discharge fluid from the conduit 108 through a conduit 112 into a sump 114. Flow control valves 116 are located in the conduits 100 and flow control valves 118 are located in the conduits 104. Branch lines 120 extend from each of the conduits 100 to the sump 114 and normally closed valves 122 are located in each of the branch lines 120.

The flow control valve 94 has three positions which are diagramatically illustrated by the blocks 124, 126 and 128. When the flow control valve is in the position shown in FIG. 4, the hydraulic fluid which is supplied by the pump 90 is redirected through the flow control valve directly to the sump 114. It will also be noted that any fluid which is located in the conduits 102, 104, 96 and 100 will be locked in the system with no escape to the sump. This is the condition which will prevail when the movable jaw is located in the set position. If during the operation of the jaw, the movable jaw resists its cyclic crushing movement to an extent sufficient to cause the pressure in the chambers 64 to exceed the relief pressure established by the safety relief valve 110, the relief valve 110 will be displaced to the relief position to permit hydraulic fluid to escape from the chamber 64 to the sump and thereby permit the pistons 62 to be deflected to the left of the position shown in FIG. 4 to permit the movable jaw to move from its said position toward the first rejected position.

During the initial setup, when it is necessary to position the pistons 62 to the right of the position shown in FIG. 4 to establish a new set position, the control valve 94 is adjusted to the position in which the block 124 is aligned with the supply and return lines. As a result, hydraulic fluid from the line 92 passes through the one-way check passage 130 to the line 96 from which it passes to the chambers 64. This will serve to deflect the pistons 62 to the right of the position shown in FIG. 4 and the fluid which is displaced from the chambers 66 will return to the sump 114 through the port 72, conduits 104 and 102 and the return passage 132.

When it is necessary to adjust the set position to the left of any previously set position, the control valve 94 is positioned so that the block 128 is aligned with the fluid supply and return conduits. As a result, fluid under pressure from the conduit 92 passes to the conduit 102 through the one-way check valve line 134. The fluid passes through the conduit 102 and conduits 104 to the port 72 and into the chambers 66 to move the pistons 62 to the left of the position shown in FIG. 4. The fluid which is expelled from the chambers 64 will return to the sump 114 through the conduits 100, conduit 96 and return line 130.

Thus it will be seen that the hydraulic control means of the present invention not only serves to provide a simple and inexpensive safety relief system which will relieve the pressure in the system when excessive pressure are developed but also makes provision for the simple adjustment of the set point of the movable jaw. All of this is achieved without the need to provide a separate pneumatically powered damping system.

It will also be apparent that in circumstances where the movable jaw becomes locked in a stationary position in which a load of rock is trapped between the jaws under a very high pressure which does not exceed the safety relief pressure, it is possible to move the movable jaw to an open position by moving the three-position control valve 94 to the position identified diagramatically by the block 134 which serves to supply hydraulic fluid under pressure to the compartments 66 so as to drive the piston 62 to the left of its set position shown in FIG. 4. Consequently, this hydraulic system not only provides a pressure relief mechanism which avoids overloading of the system, it also provides a mechanism for driving the movable jaw away from its set position to open the jaws and thereby relieve the pressures applied to the load to facilitate the clearing of an obstruction from the bite of the jaws.

These and other advantages of the present invention will be apparent to those skilled in the art.

I claim:

1. In a jaw crusher for crushing rock of the type having a frame, a fixed jaw mounted on the frame and a movable jaw mounted on the frame for movement toward and away from the fixed jaw between a first set position which determines the maximum size of the gap formed between the jaws for a predetermined jaw setting and a first advanced position in which the movable jaw is located more closely adjacent the fixed jaw, and wherein the movable jaw is movable from the first set position to a retracted position in which it is more remote from the fixed jaw than it is when it is in the first set position so as to facilitate the removal of obstructing material from the bite which is formed between the jaws, the improvement of;

hydraulic control means for controlling the movement of the movable jaw between said first set position and said retracted position comprising;

(a) a double acting hydraulic ram having first and second ends mounted on the frame and movable jaw respectively, and being extensible and contractable between said ends, said ram comprising a cylinder, a piston slidably mounted in the cylinder and dividing the cylinder into first and second fluid chambers, a rod extending from the piston and projecting from one end of the cylinder, one of said ends of said ram being located on said cylinder and the other being located on said rod, first and second fluid ports communicating with said first and second chambers respectively, movement of said piston resulting from expansion of said first fluid chamber serving to move the movable jaw to said first set position and movement of said piston resulting from expansion of said second fluid chamber serving to move the movable jaw to said retracted position, (b) a source of high pressure hydraulic fluid, (c) first fluid supply conduit means communicating between said source and said first fluid chamber to supply and vent hydraulic fluid from said first fluid chamber, (d) second fluid supply conduit means communicating between said source and said second fluid chamber to supply and vent hydraulic fluid from said second fluid chamber, (e) flow control means in said first and second fluid supply conduit means for simultaneously locking hydraulic fluid in said first and second fluid supply conduits to hold the extensible ram in a substantially rigid fixed length condition when in said set position during normal operation of the crusher, (f) non-pneumatic pressure relief means communicating with said first fluid chamber to relieve the pressure in said first fluid chamber when the pressure in said first fluid chamber exceeds a predetermined control pressure to free the movable jaw for movement toward said retracted position.

2. In a jaw crusher for crushing rock of the type having a frame, a fixed jaw mounted on the frame and a movable jaw mounted on the frame for movement towards and away from the fixed jaw betwen a first set position which determines the maximum size of the gap formed between the jaws for a predetermined jaw setting and a first advanced position in which the movable jaw is located more closely adjacent the fixed jaw, and wherein the movable jaw is movable from the first set position to a retracted position in which it is more remote from the fixed jaw than it is when it is in the first set position so as to facilitate the removal of obstructing material from the bite which is formed between the jaws, the improvement of;

hydraulic control means for controlling the movement of the movable jaw between said first set position and said retracted position comprising;

(a) a pair of double acting hydraulic rams each having first and second ends mounted on the frame and movable jaw respectively, and being extensible and contractable between said ends, each ram comprising a cylinder, a piston slidably mounted in the cylinder and dividing the cylinder into first and second fluid chambers, a rod extending from the piston and projecting from one end of the cylinder, one of said ends of each ram being located on said cylinder and the other being located on said rod, first and second fluid ports communicating with said first and second chambers respectively, movement of said piston resulting from expansion of said first fluid chamber serving to move the movable jaw to said retracted position, (b) a source of high pressure hydraulic fluid, (c) first fluid supply conduit means communicating between said source and each first fluid chamber to supply and vent hydraulic fluid to and from each first fluid chamber, (d) second fluid supply conduit means communicating between said source and each second fluid chamber to supply and vent hydraulic fluid to and from each second fluid chamber, (e) flow control means in said first and second fluid supply conduit means for simultaneously locking hydraulic fluid in said first and second fluid supply conduits to hold the extensible ram in a substantially rigid fixed length condition when in said second position during normal operation of the crusher, (f) non-pneumatic pressure relief means communicating with each of said first fluid chambers to simultaneously relieve the pressure in said first fluid chambers when the pressure in said first fluid chambers exceeds a predetermined control pressure to free the movable jaw for movement toward said retracted position.

* * * * *